US005924732A

United States Patent [19]

Olsen

[11] Patent Number: 5,924,732

[45] Date of Patent: Jul. 20, 1999

[54] IN-LINE SKATE SAIL

[76] Inventor: Dennis Olsen, 12334 Wycliff Pl., Tampa, Fla. 33626

[21] Appl. No.: 08/772,417

[22] Filed: Dec. 23, 1996

[51] Int. Cl.[6] ..... A63C 3/00

[52] U.S. Cl. ..... 280/810; 280/811; 280/809

[58] Field of Search ..... 280/810, 809, 280/811, 812, 819, 213; 36/71.5; 114/39.2, 103

[56] References Cited

U.S. PATENT DOCUMENTS

| | | | |
|---|---|---|---|
| 2,490,183 | 12/1949 | Wheeler | 280/809 |
| 3,982,766 | 9/1976 | Budge | 280/1 |
| 4,130,292 | 12/1978 | Lorenz | 280/11.37 S |
| 4,204,694 | 5/1980 | Freeman | 280/810 |
| 4,234,211 | 11/1980 | Lux | 280/810 |
| 4,269,133 | 5/1981 | Brown | 114/103 |
| 4,311,324 | 1/1982 | Fries | 280/810 |
| 4,489,957 | 12/1984 | Holmgren | 280/810 |
| 4,533,159 | 8/1985 | Seidel | 280/810 |
| 4,978,140 | 12/1990 | Babson | 280/810 |
| 5,285,742 | 2/1994 | Anderson | 280/213 |
| 5,359,797 | 11/1994 | Williamson | 280/816 |
| 5,535,692 | 7/1996 | Ezzy | 114/103 |

FOREIGN PATENT DOCUMENTS

| | | | |
|---|---|---|---|
| 145854 | 12/1903 | Germany | 280/810 |
| 3302515 | 8/1984 | Germany | 280/810 |

*Primary Examiner*—Richard M. Camby
*Assistant Examiner*—Michael Cuff
*Attorney, Agent, or Firm*—Pendorf & Cutliff

[57] ABSTRACT

A device particularly suitable for propelling an in-line skater by harnessing the energy of air currents. More particularly, the invention concerns a device which is particularly effective in harnessing and transmitting air current energy to an in-line skater in a controllable, simple, and intuitive manner. The device is simple to construct, rugged and durable, and safer to use than conventional sail devices. The device is easily disassembled and in the disassembled state assists the skater to return to an upwind starting position.

5 Claims, 4 Drawing Sheets

IN-LINE SKATE SAIL

BACKGROUND OF THE INVENTION

1. Field of the Invention

The present invention concerns a device particularly suitable for propelling an in-line skater by harnessing the energy of air currents. More particularly, the invention concerns a device which is particularly effective in harnessing and transmitting air current energy to an in-line skater in a controllable, simple, and intuitive manner. The device is simple to construct, rugged and durable, and safer to use than conventional sail devices. The device is easily disassembled and in the disassembled state assists the skater to return to an upwind starting position.

2. Description of the Prior Art

In-line skating, also known as roller blading, is a popular recreational activity. As compared to roller skates, wherein four wheels are distributed around the four corners of the foot providing a stable platform, in-line skates have wheels arranged in a line. Due to this wheel configuration in-line skates are more maneuverable than roller skates, but at the same time are more unstable and require greater ankle strength and skill to use.

The increase in popularity of in-line skates has spawned an increase in developmental activity leading to a variety of improvements or refinements as evidenced by, e.g., U.S. Pat. No. 5,382,052 for an in-line roller blade figure skate and U.S. Pat. No. 5,239,941 concerning a braking system for in-line roller skates. Further evidencing the popularity of roller blades is the "roller boot" described in U.S. Pat. No. 5,507,506 comprising a boot and a wheel frame wherein the wheel frame can be detached from the boot and the boot can be used for walking.

While in-line skates were primarily designed for the recreational and exercise benefit of the skating activity, experiments have been made to use in-line skates as a basis for short distance transportation, including attempts to connect propulsion means to in-line skates. For example, small motors have been coupled to one of the wheels of an in-line skate whereby a skater can be propelled along level ground at speeds of up to 20 mph. However, such a device has many disadvantages. Any mechanical device is prone to mechanical failure. Motors containing flammable material may not be allowed indoors or near flames. Motors require servicing including filling with gas. The range of transport depends upon the amount of fuel carried. The attachment of a heavy motor to an in-line skate renders the skate bulky such that the in-line skates can not be used in a normal manner. Further, the mounting of a motor is not a simple matter, requires special hardware and adaptations, and can not easily be removed. A motor based system for an in-line skate is relatively expensive. Parents would not consider this system safe for children, considering the speeds achieved and the likelihood of meeting traffic. The two-stroke motor exhaust fumes are offensive to those desiring the benefits of fresh air while exercising. Accordingly, the motorized approach to propelling skates has not met with commercial success.

The relatively low power and endurance of an in-line skater is particularly challenged on windy days, especially when the skater is attempting to skate into the wind. Accordingly, in-line skaters tend to skate on days where skating is not hampered by wind. This limits the number of days during which skates can be used, which may be a problem in windy regions.

Another problem with in-line skates is that it is easy to become hot and fatigued. Thus, a means of propulsion which would not exhaust the skater, not pollute the atmosphere, and help keep the skater excited yet cool, would be welcome in this sport.

Accordingly, there is a need for an external propulsion device for a in-line skater. There is also a need for a device which enables an in-line skater to skate on windy days. There is also a need for a new device which can be associated with in-line skating and which would greatly enhance the enjoyment of in-line skating, particularly on windy days.

In view of the above, the present inventor desired to propel himself using air currents, and undertook investigation into prior art attempts to harness the energy of air currents to skiers, skaters, or skateboarders. The inventor soon realized that, given the differences in the way energy is transmitted through the human body to in-line skates and the manner in which sails have previously been connected to the human body, the known methods of harnessing air currents are unsuitable for application to in-line skating.

For example, U.S. Pat. No. 3,982,766 teaches a wind-propelled skateboard including a skateboard for transporting a skateboarder, a mast which is detachably coupled to the body of the skateboard in such a manner that it is substantially free from pivotal restraint, a boom coupled to the mast by a hinge, and a triangular sail coupled to both the mast and the boom. This inventor essentially adapted the sail from a wind surfer (a wind propelled surfboard) to a skateboard. However, such a design cannot be adapted to in-line skates for a number of reasons. First, the skater does not have a stable platform to which to attach a sail. Attaching a mast of a sail to only one of two in-line skate boots would put significant downward pressure on that skate, rendering the skater incapable of skating or maneuvering in a normal manner. Second, the variation in pressure applied to a sail by an air current would cause the in-line skate to which the sail is attached to be either pulled out from under the in-line skater in the case of a gust of wind or, in the case that the in-line skater is moving at a substantial speed and leaning backwards to counteract the effect of the pulling against the skate by the sail, a sudden loss of air current would cause the in-line skater to fall backwards, possibly injuring himself.

U.S. Pat. No. 4,130,292 to Lorenz teaches a more complex apparatus for propelling a skate board using air currents. A central upright mast is attached to a swivel base plate, a sail is draped from a horizontal cross-tube affixed to the top of the mast, and two booms with handles are attached to the swivel base plate such that the skate boarder can hold onto the two handles and maneuver the sail while skating. Obviously, such a complex system is completely unsuitable for adaptation to in-line skating. Further, such a complex sail design cannot be easily dismantled, disassembled and transported such as when moving from a downwind position to an upwind position.

U.S. Pat. No. 4,978,140 (Babson) teaches a hand-held skate sail which appears to be somewhat simplified over that shown in Lorenz. Basically, a fan shaped sail radiates outward from a base plate affixed to the skateboard. Such a sail would be completely unsuitable for an in-line skate application since the air currents would have to pass through the body of the in-line skater to impact upon a sail. Since this sail is designed to redirect the flow of air currents directly upwards, this arrangement would be completely inefficient and unworkable when considering an in-line skate application.

U.S. Pat. No. 4,489,957 (Holmgren) teaches a tool for sailing with skates, skis, roller skates, skateboards or corresponding gear. According to Holmgren respective ends of a carrier bar are fastened to the sailor's feet. While this device would enable a rather large mast to be attached to a skater, a significant number of obvious disadvantages render this design unsuitable for adaptation to in-line skates. First, the shackling of a transverse member to both feet removes a large amount of control from the in-line skater rendering the sport more dangerous. Second, the in-line skater, having achieved a substantial forward momentum, cannot easily steer this device or stop when approaching an obstacle. In the case that the in-line skater having such a sail attached to his feet panics and drops the sail, the skater would immediately stop due to jamming of the sail under the roller blades or else would drag the sail on the ground. In either case, the sudden deceleration at the base of the in-line skater would cause the in-line skater to fall forward and likely injure himself.

U.S. Pat. No. 4,204,694 (Freeman) teaches a sail apparatus for propelling a moveable body such as a skate, ski, an ice boat or the like. An upper spar and lower boom are used to hold a triangular shaped sail in an open triangular form. The mast is connectable to the spar end boom for supporting the sail above the moveable body. The bottom of the mast is detachably coupled to the transport body in such a manner that the mast may be articulated with respect to the body in any direction. However, one problem with such a device is that the sail must be in close proximity to the human body, thus the body of the sailor blocks the air current and diminishes the effectiveness of the sail. A further disadvantage is that, in the case of propelling skates or skis, the sail must be attached to the human body by a harness as shown in FIG. 4 of this patent. The direct coupling of the sail to the human body increases the danger of the sport in that the sailor cannot readily disengage himself from the sail in the case of an imminent collision. A further problem is that the sail is directly connected to, and places significant downward pressure, on one foot of the sailor, thereby impeding mobility of that ski or skate. Finally, this device is complex to use, requires education and experience, and is relatively complex in its construction.

U.S. Pat. No. 4,269,133 (Brown) teaches a hand-held sail having a unique design and capable of propelling a skater across a horizontal surface. The sail is essentially a "delta" sail with a central transecting boom, the boom including a U-shaped projection which can be grasped by the sailor. A harness formed by a strap is attached to the U-shaped portion and looped around the neck of the sailor. However, on consideration, it can be seen that such a device is inefficient as a means of propelling a skater for two main reasons. First, the requirement to transmit the horizontal propelling forces generated in the sail horizontally through the neck and shoulder of the sailor, then perpendicularly downward through the length of the body, then perpendicularly to the skates, requires a great amount of muscle tone, coordination, concentration and provides the least amount of control, particularly in variable winds. Second, the requirement to place the sail directly downwind of the sailor renders the sail inefficient as a device for capturing air currents.

U.S. Pat. No. 4,311,324 (Fries) teaches a sail device for use in propelling a roller skater, ice skater or the like. The device appears to be easy to operate in that it employs a balancing pole, with the sail being suspended between the balancing pole and the individual skates. Therewith the propulsion forces of the wind are efficiently transmitted in part to the arms and in part directly to the feet, and the balancing pole helps the skater maintain balance. However, a significant disadvantage with this system is that the balancing pole projects outwardly a great length on either side of the skater, such that the device can only be used where there is a board clear path. Further, while the balancing pole increases stability of the sailor against falling down, it diminishes the ability to turn. Further, while the low center of gravity of the sail area reduces leverage against the sailor and thereby increases stability, air currents are greatly reduced near the ground, so this configuration requires a large sail area to capture diminished air currents. Another problem is caused by the combination of the heavy weight of the balancing pole and the fact that the sailor must apply constant upwards pressure on the pole to keep the sail taught and capture wind. This requirement to constantly pull upwards on the balancing pole will soon tire the sailor. Further, sails provided downwind of the sailor have air currents blocked by the body of the sailor, and this arrangement has a particularly high amount of blockage. Thus, such a sail arrangement is very efficient. Further, since the sails are fixedly attached to the skates of the sailor, the sailor can not stop or disengage from the activity by simply dropping of the sail, since this would result in the sail tangling or acting as an anchor to the skates, causing the sailor to fall forward. Finally, once the skater has allowed themselves to be pushed downwind, there arises the problem of how to return upwind, carrying the balancing pole and sail. It can thus be seen that what may at first glance looks like a good idea does not translate into a workable sail device.

Accordingly, what is needed is a new device which would enable an in-line skater to more effectively harness air currents. In order to have great practical and commercial appeal, the device must be relatively simple, rugged, durable, and safe, i.e., it cannot be directly attached to the sailor by means of harnesses, buckles or other attachment means. What is needed is a device for propelling an in-line skater which can be easily controlled and maneuvered so long as the sailor feels comfortable, and can be completely released and disengaged from when the sailor sees imminent danger.

Further yet, there is a need for a device which is intuitively much easier to operate than the above described devices, and which optimizes the leverage forces between the wind current, sail, mast, sailor body and mast attachment point.

Finally, there is a need for a device which can be used not only to propel the skater downwind, but which also assists the skater to return to the upwind starting point, thereby completing a cycle of use.

SUMMARY OF THE INVENTION

Having considered the problems associated with in-line skating, particularly in the wind, and having experimented with various types of sail structures and sail support means, the present inventor discovered a new and unique sail design particularly suitable for use in conjunction with roller skates, in-line skates, or ice skates, hereafter collectively referred to as skates, wherein the skater desires to maintain a balanced and relatively unobstructed range of flexible motion in both feet. The novel sail structure is designed to project mainly over the head of the sailor, thereby to capture air currents in the area of greatest velocity without being blocked by the body of the sailor. A surprising additional benefit of the sail device according to the invention results from an effect which is peculiar to low-friction in-line skates—namely, the effect that, although sails pull the skater, dropping the sail will usually not cause the sail to drop forward. Rather, the sail will collapse and slow down, while the skater at the same time maintains speed, thus moving faster than the sail. Thus, releasing the sail will not result in the sail falling in front of the skater, but rather will result in the sail passing over the head of the skater. Accordingly, since the sail according to the present invention is provided entirely or substantially above the head of the skater, in order to disengage himself from the sail device according to the present invention the sailor need merely release his grasp on the poles and slightly duck his head, proceeding under the sail. This effect renders the present sail device safer and completely different from any other known sail device for propelling skaters.

The sail device according to the present invention is designed not to have any elements which project horizontally sideways out from the skater during use, which projections might establish a threat to other skaters or persons in the path of the skater.

More specifically, the present invention concerns a device for use in conjunction with foot mounted skates, the term skates referring to roller blades, roller skates, in-line skates, ice skates, etc., comprising a first pole having an upper end and a lower end; a second pole having an upper end and a lower end; a sail having a first side and a second side and an upper edge and lower edge, the first edge of the sail being attached to the first pole during use, the second edge being attached to the second pole during use, such that the upper edge of the sail is attached at or near the upper ends of the first and second poles, thereby defining a sail area covering at least one third of the length of the poles; first means for affixing to a first skate and adapted for receiving the lower end of the first pole, and second means for affixing to a second skate and adapted for receiving the lower of end of the second pole.

In a preferred embodiment of the invention, a transparent window is incorporated in the lower area of the sail. Thereby the sail mass can be made sufficiently large for capturing air currents, yet can cover the area at or below shoulder level without interfering with the forward visibility of the skater.

It is also preferred in the present invention to use two poles of substantially the same length, but rather than being made of a rigid material, the poles are made of a slightly flexible material. This flexibility has been found in practice to aid in the spreading apart of the poles. It also provides somewhat of a shock absorber effect.

In a yet further embodiment of the invention, the sail is attached to at least one of the poles by quick release means such as snap fittings, VELCRO hook and pile fasteners, or by forming a pocket along the length of one of the sides of the sail, such that the pole can be simply inserted into the pocket and then the sail fastened near the mouth of the socket by any conventional means such as snap fittings. The ability to separate one of the poles from the sail and second pole permits the sail to be wound around (or into) the remaining pole such that the two poles can be used in the manner of ski poles when an exhausted in-line skater is attempting to travel up-hill or back into the wind.

In a very basic design of the sail device of the present invention, both side edges of the sail are sewn into pockets, the two poles are simply inserted into the pockets, and the sails maintained on the poles by means of snap fittings. Pocket type attachment means are preferred over the case of loops or rope lashing in that there are no air gaps between the poles and sails in the case of pockets, while loops or rope leave air gaps, which reduce the effective sail area.

In a yet further embodiment of the invention one pole, say, the first pole, is constructed as a hollow tube, the sail is connected to a dowel which fits loosely inside the hollow pole (e.g., by sewing, stapling, screwing, or by splitting the dowel in half, introducing the sail edge between the halves, and rejoining the dowel halves by any means such as gluing, screwing or stapling), the dowel is provided with a crank or handle which extends radially from the upper end of the first pole, and during use the sail is in an unwound state. After use, for protection or storage of the sail, the sail is simply wound around the dowel by rotating the crank. In this embodiment the second edge of the sail may remain attached to the second pole, or the second edge of the sail may be detached from the pole.

Of course, the sail and poles may be constructed of any materials conventionally employed in the art. For example, the pole may be kevlar, carbon fiber, plastic, or a light weight metal such as aluminum. The sail may be silk, kevlar, cloth or plastic.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other sail devices for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the present invention reference should be made by the following detailed description taken in with the accompanying drawings in which.

DETAILED DESCRIPTION OF THE INVENTION

The invention will be described in greater detail with reference to the accompanying drawings.

Figure 1:
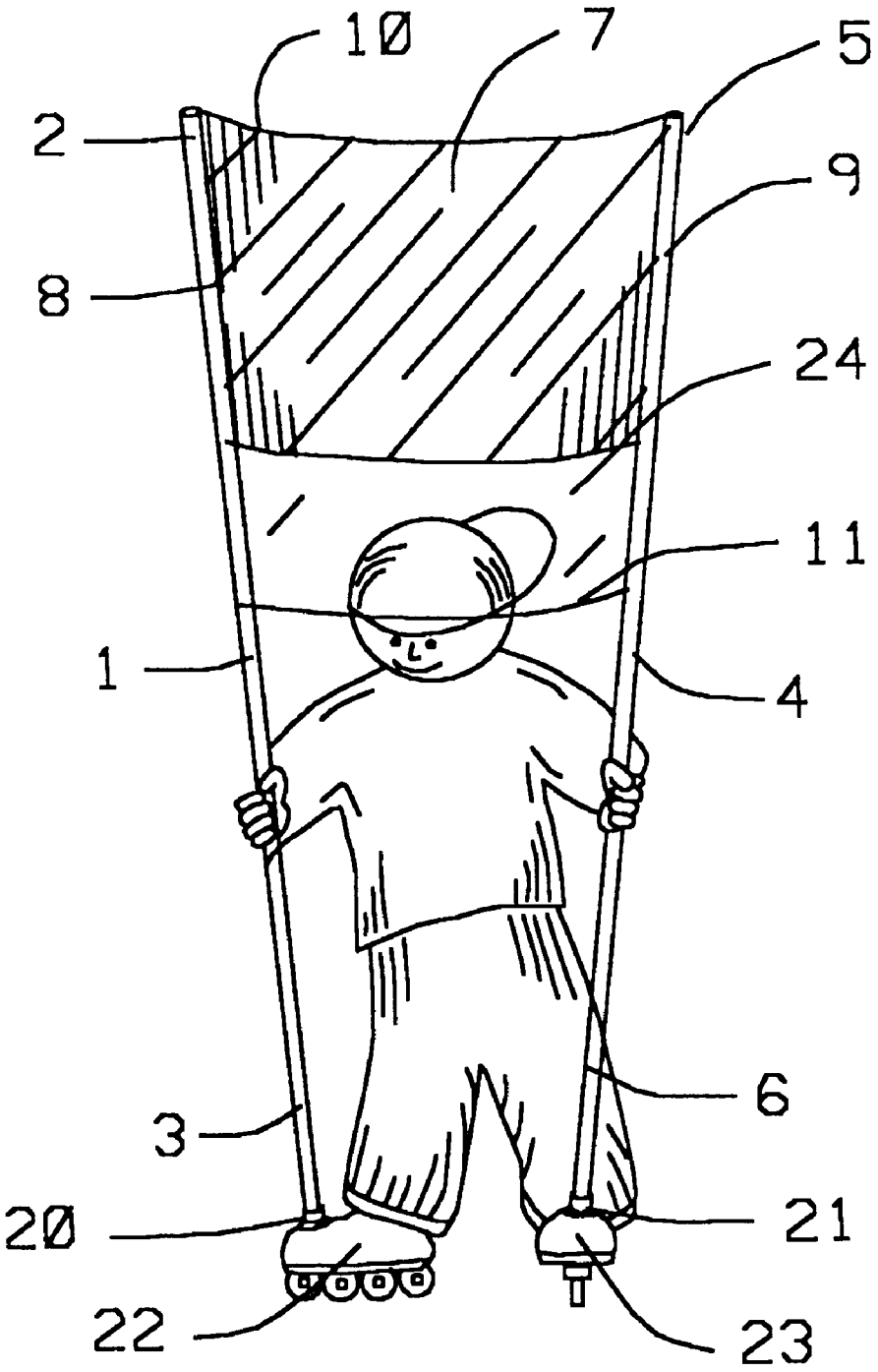
FIG. 1 is an elevated front view of an embodiment of the invention showing a sail with window in use.

As can be seen from FIG. 1, device according to the present invention is perfectly balance on the skater such that the skater has a balanced and relatively unobstructed range of flexible motion in both feet. The novel sail structure projects mainly over the head of the sailor, thereby capturing air currents which are both in the area of greatest velocity and unobstructed by the body of the skater. This design enables the square footage of the sail to be reduced and allows the device to be made smaller and more controllable. The sail is designed not to have any elements which project horizontally sideways out from the skater during use, and thus the skater can skate through a crowd or along a narrow path without fear that any sideways projections might establish a threat to other skaters or persons in the path of the skater.

More specifically, as seen in FIG. 1, the present invention concerns a device for use in conjunction with foot mounted skates, the term "skates" referring to roller blades, roller skates, in-line skates, ice skates, etc. The device comprises a first pole 1 having an upper end 2 and a lower end 3; a second pole 4 having an upper end 5 and a lower end 6; a sail 7 having a first side 8 and a second side 9 and an upper edge 10 and lower edge 11, the first edge 8 of the sail 7 being attached to the first pole 1 during use, the second edge 9 being attached to the second pole 4 during use, such that the upper edge 10 of the sail 7 is attached at or near the upper ends 2, 5 of the first and second poles 1, 4, thereby defining a sail area between the poles covering at least one third of the length of the poles. The device preferably includes first means 20 for affixing to a first skate 22 and adapted for receiving the lower end 3 of the first pole 1, and second means 21 for affixing to a second skate 23 and adapted for receiving the lower end 6 of the second pole 4.

As further shown in FIG. 1, in order to capture the air currents above the head area of the skater without however interfering with the forward visibility of the skater, a preferred embodiment of the invention incorporates a transparent window 24 in the lower area of the sail. Thereby the sail mass is sufficiently large to capture the strongest air currents, the sail extends down to capture air currents in the shoulder area which are only slightly blocked by the head, yet the sail does not interfere with the visibility of the skater.

Figure 2:
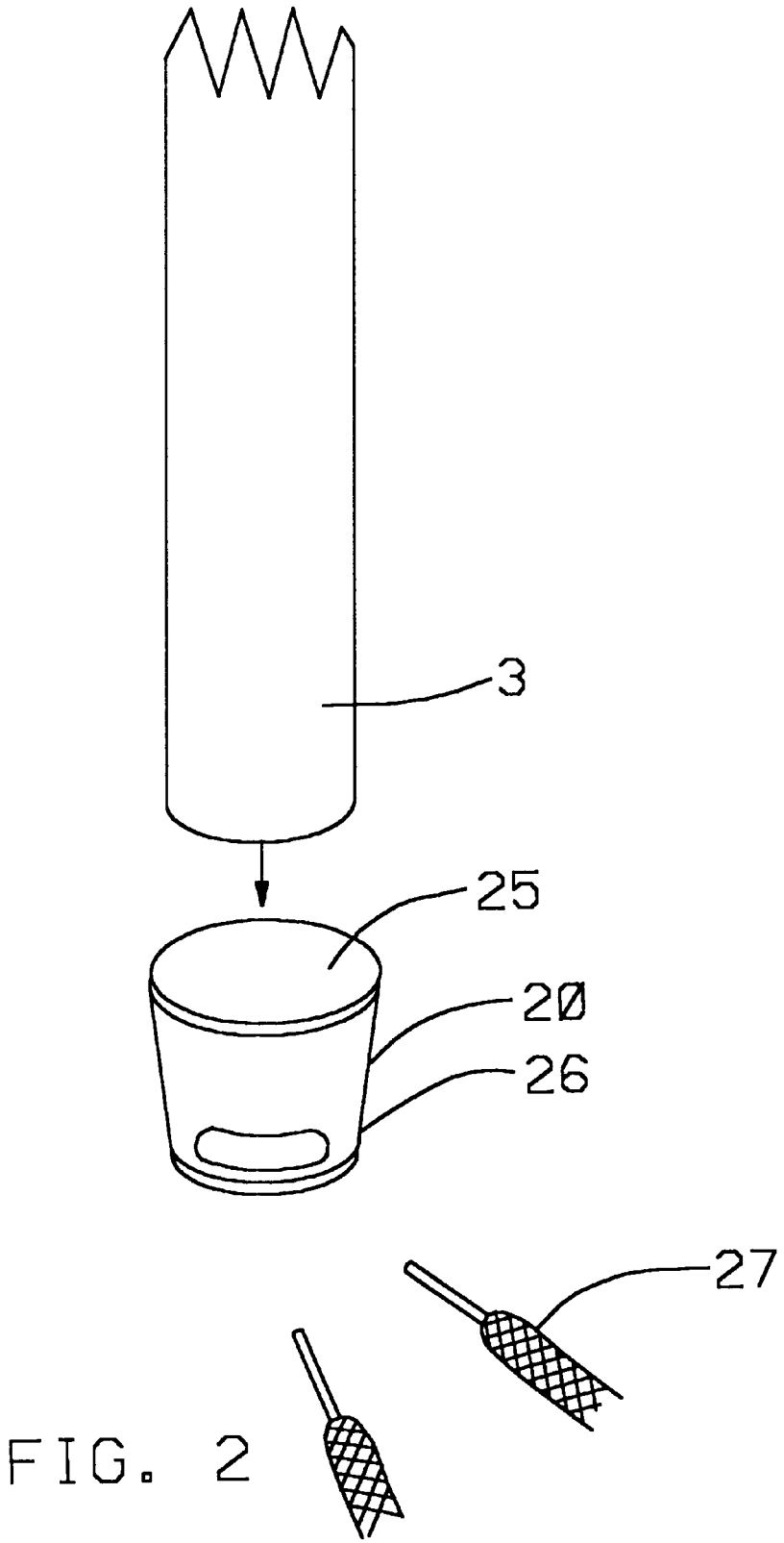
FIG. 2 is an elevated oblique view showing means for attachment to a conventional skate and adapted for receiving a pole.

In order to anchor the poles to the skates, yet be able to instantly and completely disengage from the sails in case of an emergency, the skates are preferably provided with supplemental means for receiving and releasably securing the poles. These means may be in the shape of a cylindrical cup as shown in FIG. 2 for receiving the bottom of a tubular pole as shown in the drawings, or may be in the shape of a spherical socket for receiving ball shaped or rounded off lower end of a pole, or may be in the form of a projection for engagement with a hollow lower end of a pole. The engagement means may either be a separate article which can be attached to a conventional skate which is not provided with means for holding a pole, or the engagement means may be molded directly into the plastic body of the skate boot.

In order to be able to adapt existing skates to receive the device according to the present invention, the means 20 for receiving the pole 1, hereafter receptacle 20, is preferably provided in the form of a hollow cup or socket 25 adapted for snugly yet releasably receiving the lower end of the pole 3. To secure the receptacle 20 to the skates 22, the receptacle 20 may be provided with a through hole 26 through which a shoe lace 27 can be threaded. The through hole is preferably elongated rather than round, such that the shoe lace can make two or more passes through the through hole. That is, a shoe lace should be completely removed from a skate, threaded through the receptacle through hole 26 one or more times, the receptacle centered above the arch of the foot as shown in FIG. 1, and the shoe laces simultaneously being threaded back into the skate. Of course, many alternate methods for securing the receptacle to the skate may be envisioned, such as VELCRO hook and pile fasteners, belting, super adhesive glue, etc. There is no particular limitation with respect to the shape or method of attachment of the receptacle 20 to the skate 22. In order to spread out the downward pressure of the pole 1 on the skate 22. Of course, the receptacle may be formed integrally with the skate, which may be the case particularly where the in-line skates are designed and purchased especially for use with the sail device according to the present invention.

Of course, it is also possible to provide the lower ends of the poles with upside down "U" shape so that the poles can be planted on top of the skates without requiring any receptacle on the skates, but in practice the provision of a receptacle on the skate is greatly preferred.

The sail itself may be either constructed from a single sheet of flat material, or may be billowed or tailored to optimize the capturing of air currents.

The poles 1, 4 may be solid or hollow, and may be one piece or may be constructed as two or more interlocking segments capable of being detached from each other in order to reduce overall length of the disassembled device for ease of transport in a travel bag, a trunk of an automobile, etc. Alternatively to detaching, the two poles may be include a first hollow tube segment having a larger inner diameter than the outer diameter of the second tube segment, such that the two tube segments can be reduced in length by simply sliding the second half into the first half.

Figure 3:
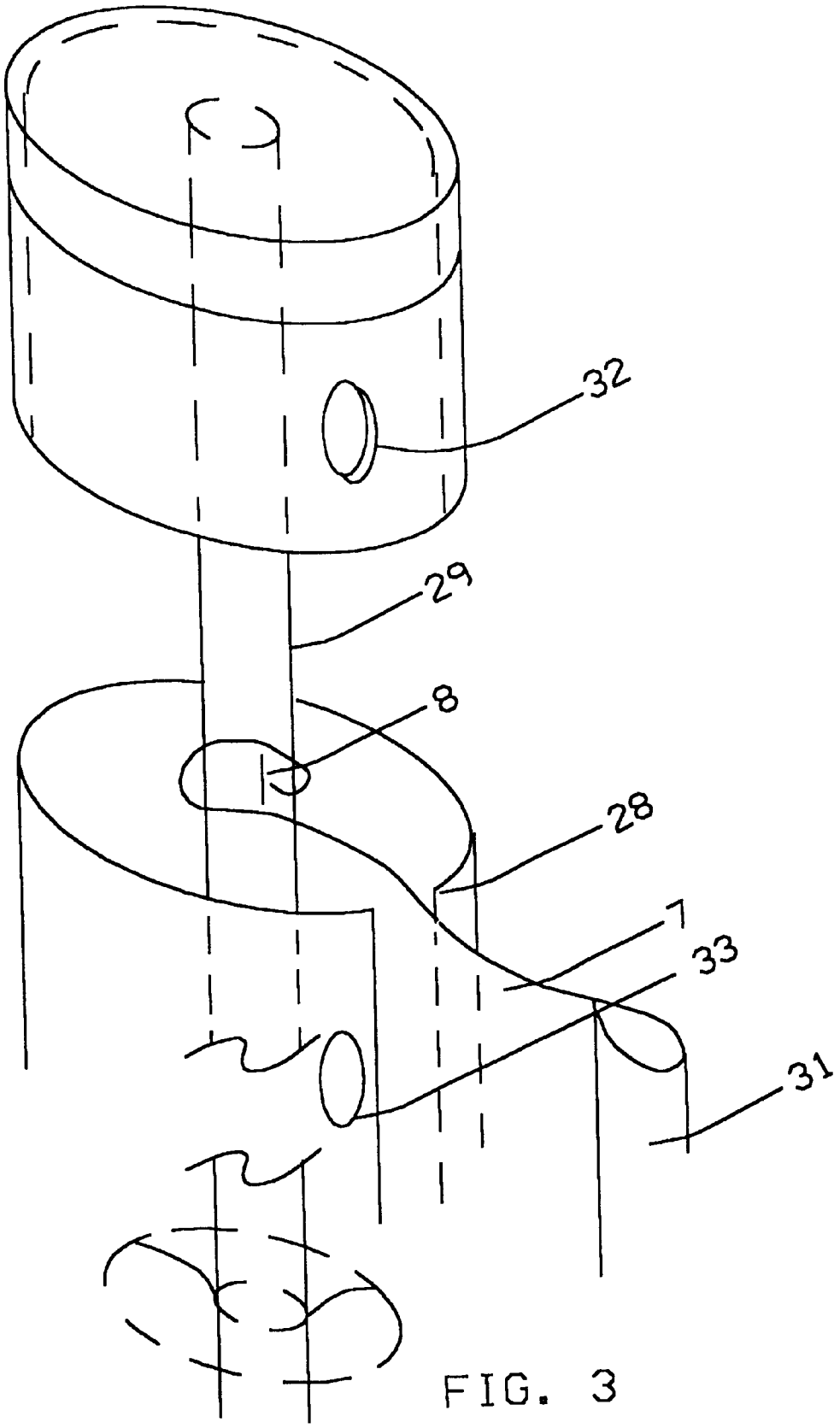
FIG. 3 is an elevated oblique view of an arrangement in which the sail can be retracted into one of the poles by winding about a core dowel.

In a yet further embodiment of the invention one pole, say, the first pole 1, is constructed as a hollow tube with a slit 28, the first edge 8 of the sail 7 is connected to a dowel 29 which fits loosely inside the hollow tube with slit 28. The dowel is provided with a crank or handle or cap 30 which sits on top of the upper end of the first pole 1. During use the sail is pulled out and spans between the two poles in an unwound state. After use, for protection or storage of the sail, the sail is simply wound around the dowel 29 as shown in FIG. 3, which can be accomplished by rotating the crank or cap 30. Cap 30 is preferably made of a durable rubber and is thus somewhat flexible. Cap 30 can be secured to the pole either by a frictional fitting, or by providing a hole 32 in the cap and registering this hole 32 over a matching button 33. In this stored configuration the second edge 9 of the sail 7 may remain attached to the second pole 4, or the second edge 9 of the sail 7 may be detached from the second pole 4 and wound completely inside the first pole leaving no "shirt tail". To retrieve the sail, the cap 30 is simply lifted axially above the pole in order to expose sufficient sail edge to grasp and pull out or unwind through the slit. Once the sail is completely pulled out, the cap is again seated on top of the pole. With the cap so seated, the strength of the pole with slit is greatly increased since it now becomes extremely difficult for the sail in use to widen the slit. Of course, since the dowel is moveable axially, the base of the dowel must be rotatably and axially slidably anchored, such as by providing a funnel shaped fitting with a narrow diameter hole sufficiently large for the dowel to seat, with the dowel being sufficiently long that the base of the dowel (opposite end from the cap) remains in the hole even when the cap end of the dowel is pulled out for purposes of furling or unfurling the sail.

In yet further embodiments of the invention, the sail is attached to at least one of the poles by quick release means such as snap fittings, VELCRO hook and pile fasteners, by conventional canvas securing means, or by forming a pocket 31 along the length of one of the sides of the sail 7, such that the pole 4 can be simply inserted into the pocket 31 after which the sail can be anchored via a fastener provided near the mouth of the socket. This fastener may be any conventional fastener hardware such as snap fittings which can secure the sail 7 to pole 4.

The ability to separate one of the poles from the sail and second pole permits the sail to be wound around the second pole such that the two poles can be used in the manner of ski poles when an exhausted in-line skater is attempting to travel up-hill or into the wind. In the case that the device is not so separable, the two poles can be wound together such that they can be used as a gondolier pole to pole the skater upwind.

FIGS. 6 and 7 show a sail 34 with a small central window 35 which may be preferred in the case of competition where a large surface are is preferably devoted to advertising space, logos, etc., and a solid sail 36.

Figure 4:
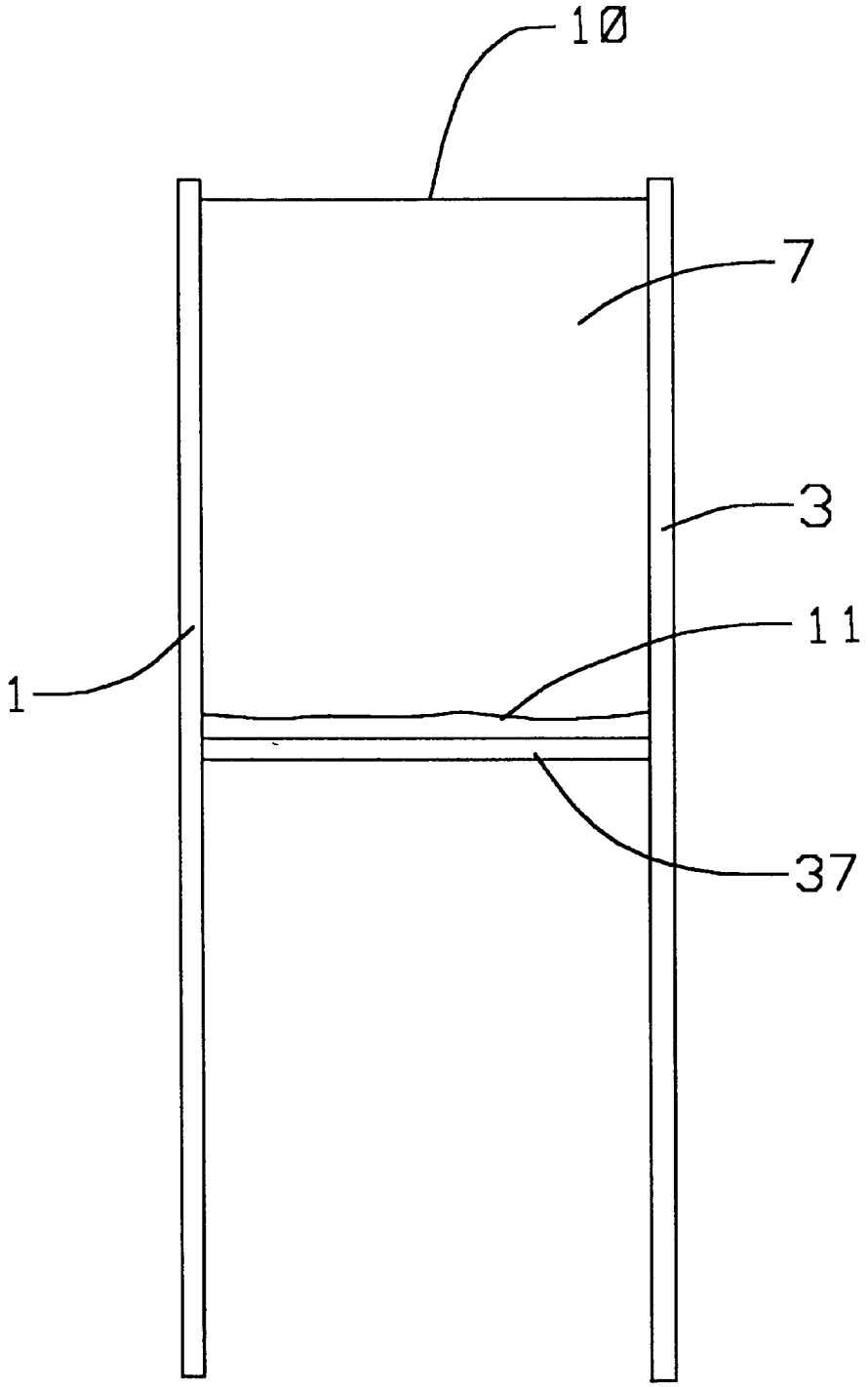
FIG. 4 is a front view showing a sail with brace.

Although the sail device can be constructed in a simple manner by simply spanning a sail between two upright poles, the sail device may also include a transverse brace which may be a lower brace 37 as shown in FIG. 4 or, alternatively, an upper brace. The brace may be fixed or articulated, rigid or flexible, and may found by some persons to provide some degree added control and ease of maintaining separation between the poles. However, a brace is not necessary, and in consideration of ease of construction, maintenance and use, the brace may be completely omitted from the sail device according to the present invention. Such a brace could be provided as an option in the manner that training wheels are provided with bicycles, such that the brace could be used by a beginner or amateur and removed in the case of an accomplished skater, and again attached for a professional or experienced skater desiring to do tricks.

The method of use of the device according to the present invention is readily apparent from FIG. 1 showing a child using the device according to the present invention in conjunction with in-line skates. The device essentially comprises two upright poles, a sail disposed in the upper area between the poles, and means attached to the skates for releasably receiving the lower ends of the poles. Since the sail device is designed to display the sail area over the head of the skater, air currents passing over the head of the skater are captured by the sail. Since the sail is suspended between the first and second poles, and since the lower end of the poles are firmly planted on the in-line skates, the stance and manner of use of the device are intuitively appreciated by the user, and the user can manipulate the poles to capture wind without requiring any instruction.

The safety of the device according to the present invention is also readily apparent. Since the poles are releasably coupled to the roller blades, the skater can easily avoid dangerous situations by simply dropping the sail at any time and skating out of the path of the obstruction in a normal fashion. Since the device is not coupled to the skater or the skates in any way, dropping the sail will result in the skater being completely free of the sail and completely under his own power. This is of particular advantage in unfamiliar emergency situations since the skater may tend to panic and the presence of a tethered massive sail would only complicate the situation. In accordance with the present invention disengagement simply requires the skater to relinquish his grasp on the poles. Once freed of the sail device and having only his skates to control, the skater can readily regain control of the situation and avoid injury.

It will also be readily apparent that the effect of the wind is evenly distributed to both skates, and that no substantial downward forces are applied by the sail to the skates, such that the skater is free to raise and lower either or both skates from the ground, to perform jump over a ramp or attempt to fly, to skate on one skate with a second skate in the air, to spin, etc., all of which would not be possible with any of the prior art wind capturing devices.

It will also be readily appreciated that the size of the sail and the height of the sail above the ground or, to state it a more relevant way, the height of the sail above the skater, can be readily varied depending on the strength, skill level and ambient conditions. The size of the sail should be at least 2 ft. by 2.5 ft. (e.g., for a child), and may be as large as 5 ft. by 6 ft. for a conventional skater or even larger for a racer or other professional. With variation depending upon average air currents, weights and sizes of skaters, etc., the size of a conventional sail is preferably about 4 ft. in width by 5 ft. in height. The length of the poles will vary depending upon the size of the skater, but may be from 5 to 12 ft. in length, preferably 6 to 9 ft. in length.

A further advantage of the device according to the present invention is that there is no one point at which the device must be grasped. The skater can place his hands anywhere on the poles depending, on the effect to be achieved. The skater could squat, or could stand, or assume any position in between. Since the position of the hands may be varied, it follows that a large person could even use a sail device designed for a child, or an accomplished child could use a sail device designed for an adult.

Due to the lack of any side-ward projections in the device according to the present invention, the skater does not pose any threat to other pedestrians or skaters in his path, and is free to turn rapidly, rotate or twirl, kick or jump or perform any other acrobatic maneuver. This design is particularly advantageous in exciting close quarters racing.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Now that the invention has been described,

What is claimed is:

1. An air current capturing device for use in conjunction with foot mounted skates for propelling a skater, the device comprising:

a first pole having an upper end and a lower end;

a second pole having an upper end and a lower end;

a sail having a first side, and a second side, an upper edge, and a lower edge, a first side edge, and a second side edge, said first side edge of the sail being attached to said first pole during use, said second side edge of the sail being attached to said second pole during use, such that said upper edge of said sail is attached at or near said upper ends of said first and second poles, thereby defining a sail area between the poles covering one-third to one-half of the length of the poles;

first means capable of being affixed to a first skate and adapted for releasably receiving said lower end of said first pole, and second means capable of being affixed to a second skate and adapted for receiving said lower end of said second pole.

2. A device as in claim 1, wherein said sail is generally cubic and between 2 and 5 ft. in height and between 2 and 4 ft. in width.

3. A device as in claim 1, wherein said first and second poles are substantially of equal length and between 5 and 10 ft. in length.

4. A device as in claim 1, wherein said first pole is constructed as a hollow tube, wherein one edge of the sail is connected to a dowel which fits loosely inside the hollow pole, and wherein said dowel is provided with a crank which extends radially from said upper end of said first pole, wherein rotation of said crank will cause said sail to furl for storage or unfurl for operation about said dowel inside said tube.

5. A device as in claim 1, wherein both said poles are hollow.

* * * * *